US007402276B2

(12) United States Patent
Cooper

(10) Patent No.: US 7,402,276 B2
(45) Date of Patent: Jul. 22, 2008

(54) PUMP WITH ROTATING INLET

(76) Inventor: Paul V. Cooper, 11247 Lake Forest Dr., Chesterland, OH (US) 44026

( * ) Notice: Subject to any disclaimer, the term of this patent is extended or adjusted under 35 U.S.C. 154(b) by 204 days.

(21) Appl. No.: 10/773,102

(22) Filed: Feb. 4, 2004

(65) Prior Publication Data

US 2005/0013713 A1 Jan. 20, 2005

Related U.S. Application Data

(63) Continuation of application No. 10/619,405, filed on Jul. 14, 2003, which is a continuation of application No. 10/620,318, filed on Jul. 14, 2003.

(51) Int. Cl.
*F04B 17/00* (2006.01)

(52) U.S. Cl. ..... 266/235; 266/239

(58) Field of Classification Search ..... 266/239, 266/236

See application file for complete search history.

(56) References Cited

U.S. PATENT DOCUMENTS

| | | | |
|---|---|---|---|
| 209,219 | A | 10/1878 | Bookwalter |
| 251,104 | A | 12/1881 | Finch |
| 364,804 | A | 6/1887 | Cole |
| 506,572 | A | 10/1893 | Wagener |
| 585,188 | A | 6/1897 | Davis |
| 898,499 | A | 9/1908 | O'Donnell |
| 1,100,475 | A | 6/1914 | Franckaerts |
| 1,331,997 | A | 2/1920 | Neal |
| 1,454,967 | A | 5/1923 | Gill |
| 1,518,501 | A | 12/1924 | Gill |
| 1,522,765 | A | 1/1925 | Wilke |
| 1,526,851 | A | 2/1925 | Hall |
| 1,669,668 | A | 5/1928 | Marshall |
| 1,673,594 | A | 6/1928 | Schmidt |
| 1,717,969 | A | 6/1929 | Goodner |
| 1,896,201 | A | 2/1933 | Sterner-Rainer |
| 2,038,221 | A | 4/1936 | Kagi |
| 2,280,979 | A | 4/1942 | Rocke |
| 2,290,961 | A | 7/1942 | Heuer |
| 2,488,447 | A | 11/1949 | Tangen et al. |
| 2,515,478 | A | 7/1950 | Tooley et al. |
| 2,528,210 | A | 10/1950 | Stewart |

(Continued)

FOREIGN PATENT DOCUMENTS

| | | |
|---|---|---|
| CA | 683469 | 3/1964 |

(Continued)

*Primary Examiner*—Scott Kastler
(74) *Attorney, Agent, or Firm*—David E. Rogers; Squire, Sanders & Dempsey L.L.P.

(57) ABSTRACT

A device for use in a molten metal pump helps alleviate jams between a rotating rotor and stationary inlet. The device includes an inlet structure including one or more openings and a displacement structure that preferably includes one or more rotor blades. The inlet structure and displacement structure are connected to one another (preferably, but not necessarily, as a unitary piece), thus enabling them both to rotate. A pump including the device is also enclosed. The invention further includes a bearing surface for an impeller or for a device according to the invention, wherein the bearing surface includes grooves that help reduce molten metal build up between the bearing surface of the impeller or device and the bearing surface of a pump chamber.

20 Claims, 12 Drawing Sheets

U.S. PATENT DOCUMENTS

| | | | | | |
|---|---|---|---|---|---|
| 2,566,892 | A | | 9/1951 | Jacobs | |
| 2,677,609 | A | | 5/1954 | Moore et al. | |
| 2,698,583 | A | | 1/1955 | House et al. | |
| 2,787,873 | A | | 4/1957 | Hadley | |
| 2,808,782 | A | | 10/1957 | Thompson et al. | |
| 2,821,472 | A | | 1/1958 | Peterson et al. | |
| 2,832,292 | A | | 4/1958 | Edwards | |
| 2,865,618 | A | | 12/1958 | Abell | |
| 2,901,677 | A | | 8/1959 | Chessman et al. | |
| 2,948,524 | A | | 8/1960 | Sweeney et al. | |
| 2,978,885 | A | | 4/1961 | Davison | |
| 2,984,524 | A | | 5/1961 | Franzen | |
| 2,987,885 | A | | 6/1961 | Hodge | |
| 3,010,402 | A | | 11/1961 | King | |
| 3,048,384 | A | | 8/1962 | Sweeney et al. | |
| 3,070,393 | A | | 12/1962 | Silverberg et al. | |
| 3,092,030 | A | | 6/1963 | Wunder | |
| 3,227,547 | A | | 1/1966 | Szekely | |
| 3,244,109 | A | | 4/1966 | Barske | |
| 3,251,676 | A | | 5/1966 | Johnson | |
| 3,255,702 | A | | 6/1966 | Gehrm | |
| 3,272,619 | A | | 9/1966 | Sweeney et al. | |
| 3,289,473 | A | | 12/1966 | Louda | |
| 3,291,473 | A | | 12/1966 | Sweeney et al. | |
| 3,400,923 | A | | 9/1968 | Howie et al. | |
| 3,417,929 | A | | 12/1968 | Secrest et al. | |
| 3,459,133 | A | * | 8/1969 | Scheffler | 266/236 |
| 3,459,346 | A | | 8/1969 | Tinnes | |
| 3,477,383 | A | * | 11/1969 | Rawson et al. | 266/236 |
| 3,487,805 | A | | 1/1970 | Satterthwaite | |
| 3,512,762 | A | | 5/1970 | Umbricht | |
| 3,512,788 | A | | 5/1970 | Kilbane | |
| 3,575,525 | A | | 4/1971 | Fox et al. | |
| 3,618,917 | A | | 11/1971 | Fredrikson | |
| 3,650,730 | A | | 3/1972 | Derham et al. | |
| 3,689,048 | A | | 9/1972 | Foulard et al. | |
| 3,715,112 | A | | 2/1973 | Carbonnel | |
| 3,743,263 | A | | 7/1973 | Szekely | |
| 3,743,500 | A | | 7/1973 | Foulard et al. | |
| 3,753,690 | A | | 8/1973 | Emley et al. | |
| 3,759,635 | A | | 9/1973 | Carter et al. | |
| 3,767,382 | A | | 10/1973 | Bruno et al. | |
| 3,776,660 | A | | 12/1973 | Anderson et al. | |
| 3,785,632 | A | | 1/1974 | Kraemer et al. | |
| 3,814,400 | A | | 6/1974 | Seki | |
| 3,824,042 | A | | 7/1974 | Barnes et al. | |
| 3,836,280 | A | | 9/1974 | Koch | |
| 3,839,019 | A | | 10/1974 | Bruno et al. | |
| 3,871,872 | A | | 3/1975 | Downing et al. | |
| 3,873,305 | A | | 3/1975 | Claxton et al. | |
| 3,886,992 | A | | 6/1975 | Maas et al. | |
| 3,915,694 | A | | 10/1975 | Ando | |
| 3,954,134 | A | | 5/1976 | Maas et al. | |
| 3,961,778 | A | | 6/1976 | Carbonnel et al. | |
| 3,966,456 | A | | 6/1976 | Ellenbaum et al. | |
| 3,972,709 | A | | 8/1976 | Chin et al. | |
| 3,984,234 | A | | 10/1976 | Claxton et al. | |
| 3,985,000 | A | | 10/1976 | Hartz | |
| 3,997,336 | A | | 12/1976 | van Linden et al. | |
| 4,003,560 | A | | 1/1977 | Carbonnel | |
| 4,018,598 | A | | 4/1977 | Markus | |
| 4,052,199 | A | | 10/1977 | Mangalick | |
| 4,055,390 | A | | 10/1977 | Young | |
| 4,068,965 | A | | 1/1978 | Lichti | |
| 4,091,970 | A | | 5/1978 | Kimiyama et al. | |
| 4,119,141 | A | | 10/1978 | Thut et al. | |
| 4,126,360 | A | | 11/1978 | Miller et al. | |
| 4,128,415 | A | | 12/1978 | van Linden et al. | |
| 4,144,562 | A | | 3/1979 | Cooper | |
| 4,169,584 | A | | 10/1979 | Mangalick | |
| 4,192,011 | A | | 3/1980 | Cooper et al. | |
| 4,213,091 | A | | 7/1980 | Cooper | |
| 4,213,176 | A | | 7/1980 | Cooper | |
| 4,219,882 | A | | 8/1980 | Cooper et al. | |
| 4,244,423 | A | | 1/1981 | Thut et al. | |
| 4,286,985 | A | | 9/1981 | van Linden et al. | |
| 4,322,245 | A | | 3/1982 | Claxton | |
| 4,347,041 | A | | 8/1982 | Cooper | |
| 4,351,514 | A | | 9/1982 | Koch | |
| 4,360,314 | A | | 11/1982 | Pennell | |
| 4,370,096 | A | | 1/1983 | Church | |
| 4,372,541 | A | | 2/1983 | Bocourt et al. | |
| 4,375,937 | A | | 3/1983 | Cooper | |
| 4,392,888 | A | | 7/1983 | Eckert et al. | |
| 4,410,299 | A | | 10/1983 | Shimoyama | |
| 4,456,424 | A | | 6/1984 | Araoka | |
| 4,456,974 | A | | 6/1984 | Cooper | |
| 4,470,846 | A | | 9/1984 | Dube | |
| 4,489,475 | A | | 12/1984 | Struttmann | |
| 4,504,392 | A | | 3/1985 | Groteke | |
| 4,537,624 | A | | 8/1985 | Tenhover et al. | |
| 4,537,625 | A | | 8/1985 | Tenhover et al. | |
| 4,556,419 | A | | 12/1985 | Otsuka et al. | |
| 4,557,766 | A | | 12/1985 | Tenhover et al. | |
| 4,586,845 | A | | 5/1986 | Morris | |
| 4,593,597 | A | | 6/1986 | Albrecht et al. | |
| 4,598,899 | A | | 7/1986 | Cooper | |
| 4,600,222 | A | | 7/1986 | Appling | |
| 4,609,442 | A | | 9/1986 | Tenhover et al. | |
| 4,611,790 | A | | 9/1986 | Otsuka et al. | |
| 4,634,105 | A | | 1/1987 | Withers et al. | |
| 4,640,666 | A | | 2/1987 | Sodergard | |
| 4,651,806 | A | | 3/1987 | Allen et al. | |
| 4,696,703 | A | | 9/1987 | Henderson et al. | |
| 4,701,226 | A | | 10/1987 | Henderson et al. | |
| 4,714,371 | A | | 12/1987 | Cuse | |
| 4,717,540 | A | | 1/1988 | McRae et al. | |
| 4,743,428 | A | | 5/1988 | McRae et al. | |
| 4,747,583 | A | | 5/1988 | Gordon et al. | |
| 4,770,701 | A | | 9/1988 | Henderson et al. | |
| 4,786,230 | A | | 11/1988 | Thut | |
| 4,802,656 | A | | 2/1989 | Hudault et al. | |
| 4,804,168 | A | | 2/1989 | Otsuka et al. | |
| 4,810,314 | A | | 3/1989 | Henderson et al. | |
| 4,834,573 | A | | 5/1989 | Asano et al. | |
| 4,842,227 | A | | 6/1989 | Harrington et al. | |
| 4,844,425 | A | | 7/1989 | Piras et al. | |
| 4,851,296 | A | | 7/1989 | Tenhover et al. | |
| 4,859,413 | A | | 8/1989 | Harris et al. | |
| 4,867,638 | A | | 9/1989 | Handtmann et al. | |
| 4,884,786 | A | | 12/1989 | Gillespie | |
| 4,898,367 | A | | 2/1990 | Cooper | |
| 4,908,060 | A | * | 3/1990 | Duenkelmann | 75/528 |
| 4,923,770 | A | | 5/1990 | Grasselli et al. | |
| 4,930,986 | A | | 6/1990 | Cooper | |
| 4,931,091 | A | | 6/1990 | Waite et al. | |
| 4,940,214 | A | | 7/1990 | Gillespie | |
| 4,940,384 | A | | 7/1990 | Amra et al. | |
| 4,954,167 | A | | 9/1990 | Cooper | |
| 4,973,433 | A | | 11/1990 | Gilbert et al. | |
| 4,989,736 | A | | 2/1991 | Andersson et al. | |
| 5,006,232 | A | | 4/1991 | Lidgitt et al. | |
| 5,028,211 | A | | 7/1991 | Mordue et al. | |
| 5,049,841 | A | | 9/1991 | Cooper et al. | |
| 5,078,572 | A | | 1/1992 | Amra et al. | |
| 5,088,893 | A | | 2/1992 | Gilbert et al. | |
| 5,092,821 | A | | 3/1992 | Gilbert et al. | |
| 5,098,134 | A | | 3/1992 | Monckton | |
| 5,099,554 | A | | 3/1992 | Cooper | |
| 5,131,632 | A | | 7/1992 | Olson | |
| 5,143,357 | A | | 9/1992 | Gilbert et al. | |
| 5,145,322 | A | | 9/1992 | Senior, Jr. et al. | |
| 5,152,631 | A | | 10/1992 | Bauer | |
| 5,158,440 | A | | 10/1992 | Cooper et al. | |

5,162,858 A 11/1992 Shoji et al.
5,165,858 A 11/1992 Gilbert et al.
5,172,458 A 12/1992 Cooper
5,177,304 A 1/1993 Nagel
5,191,154 A 3/1993 Nagel
5,192,193 A 3/1993 Cooper et al.
5,202,100 A 4/1993 Nagel et al.
5,203,681 A 4/1993 Cooper
5,209,641 A 5/1993 Hoglund et al.
5,215,448 A 6/1993 Cooper
5,268,020 A 12/1993 Claxton
5,286,163 A 2/1994 Amra et al.
5,298,233 A 3/1994 Nagel
5,301,620 A 4/1994 Nagel et al.
5,308,045 A 5/1994 Cooper
5,310,412 A 5/1994 Gilbert et al.
5,318,360 A 6/1994 Langer et al.
5,322,547 A 6/1994 Nagel et al.
5,324,341 A 6/1994 Nagel et al.
5,330,328 A 7/1994 Cooper
5,354,940 A 10/1994 Nagel
5,358,549 A 10/1994 Nagel et al.
5,358,697 A 10/1994 Nagel
5,364,078 A 11/1994 Pelton
5,369,063 A 11/1994 Gee et al.
5,383,651 A 1/1995 Blasen et al.
5,388,633 A 2/1995 Mercer, II et al.
5,395,405 A 3/1995 Nagel et al.
5,399,074 A 3/1995 Nose et al.
5,407,294 A 4/1995 Giannini
5,425,410 A 6/1995 Reynolds
5,431,551 A 7/1995 Aquino et al.
5,435,982 A 7/1995 Wilkinson
5,436,210 A 7/1995 Wilkinson et al.
5,443,572 A 8/1995 Wilkinson et al.
5,454,423 A 10/1995 Tsuchida et al.
5,468,280 A 11/1995 Areaux
5,470,201 A 11/1995 Gilbert et al.
5,484,265 A 1/1996 Horvath et al.
5,489,734 A 2/1996 Nagel et al.
5,491,279 A 2/1996 Robert et al.
5,495,746 A 3/1996 Sigworth
5,505,143 A 4/1996 Nagel
5,509,791 A 4/1996 Turner
5,537,940 A 7/1996 Nagel et al.
5,543,558 A 8/1996 Nagel et al.
5,555,822 A 9/1996 Loewen et al.
5,558,501 A 9/1996 Wang et al.
5,558,505 A 9/1996 Mordue et al.
5,571,486 A 11/1996 Robert et al.
5,585,532 A 12/1996 Nagel
5,586,863 A 12/1996 Gilbert et al.
5,597,289 A 1/1997 Thut
5,613,245 A 3/1997 Robert
5,622,481 A 4/1997 Thut
5,629,464 A 5/1997 Bach et al.
5,634,770 A 6/1997 Gilbert et al.
5,640,706 A 6/1997 Nagel et al.
5,640,707 A 6/1997 Nagel et al.
5,640,709 A 6/1997 Nagel et al.
5,655,849 A 8/1997 McEwan et al.
5,662,725 A 9/1997 Cooper
5,676,520 A 10/1997 Thut
5,678,244 A 10/1997 Shaw et al.
5,678,807 A 10/1997 Cooper
5,679,132 A 10/1997 Rauenzahn et al.
5,685,701 A 11/1997 Chandler et al.
5,690,888 A 11/1997 Robert
5,695,732 A 12/1997 Sparks et al.
5,716,195 A 2/1998 Thut
5,717,149 A 2/1998 Nagel et al.
5,718,416 A 2/1998 Flisakowski et al.
5,735,668 A 4/1998 Klien
5,735,935 A 4/1998 Areaux
5,741,422 A 4/1998 Eichenmiller et al.
5,744,117 A 4/1998 Wilkinson et al.
5,745,861 A 4/1998 Bell et al.
5,755,847 A 5/1998 Quayle
5,772,324 A 6/1998 Falk
5,776,420 A 7/1998 Nagel
5,785,494 A 7/1998 Vild et al.
5,805,067 A 9/1998 Bradley et al.
5,810,311 A 9/1998 Davison et al.
5,842,832 A 12/1998 Thut
5,858,059 A 1/1999 Abramovich et al.
5,864,316 A 1/1999 Bradley et al.
5,866,095 A 2/1999 McGeever et al.
5,875,385 A 2/1999 Stephenson et al.
5,935,528 A 8/1999 Stephenson et al.
5,944,496 A 8/1999 Cooper
5,947,705 A 9/1999 Mordue et al.
5,949,369 A 9/1999 Bradley et al.
5,951,243 A 9/1999 Cooper
5,993,726 A 11/1999 Huang
5,993,728 A 11/1999 Vild
5,995,041 A 11/1999 Bradley et al.
6,019,576 A 2/2000 Thut
6,024,286 A 2/2000 Bradley et al.
6,027,685 A 2/2000 Cooper
6,036,745 A 3/2000 Gilbert et al.
6,074,455 A 6/2000 van Linden et al.
6,093,000 A 7/2000 Cooper
6,096,109 A 8/2000 Nagel et al.
6,113,154 A 9/2000 Thut
6,123,523 A 9/2000 Cooper
6,152,691 A 11/2000 Thut
6,187,096 B1 2/2001 Thut
6,217,823 B1 4/2001 Vild et al.
6,231,639 B1 5/2001 Eichenmiller et al.
6,243,366 B1 6/2001 Bradley et al.
6,250,881 B1 6/2001 Mordue et al.
6,254,340 B1 7/2001 Vild et al.
6,270,717 B1 8/2001 Tremblay et al.
6,280,157 B1 8/2001 Cooper
6,293,759 B1 9/2001 Thut
6,303,074 B1 10/2001 Cooper
6,345,964 B1 2/2002 Cooper
6,358,467 B1 3/2002 Mordue
6,398,525 B1 6/2002 Cooper
6,439,860 B1 8/2002 Greer
6,451,247 B1 9/2002 Mordue et al.
6,457,950 B1 10/2002 Cooper et al.
6,464,458 B2 10/2002 Vild et al.
6,495,948 B1 12/2002 Garrett, III
6,497,559 B1 12/2002 Grant
6,524,066 B2 2/2003 Thut
6,533,535 B2 3/2003 Thut
6,551,060 B2 4/2003 Mordue et al.
6,648,026 B2 11/2003 Look et al.
6,679,936 B2 1/2004 Quackenbush
6,689,310 B1 2/2004 Cooper
6,695,510 B1 2/2004 Look et al.
6,709,234 B2 3/2004 Gilbert et al.
6,716,147 B1 4/2004 Hinkle et al.
6,723,276 B1 4/2004 Cooper
6,805,834 B2 10/2004 Thut
6,843,640 B2 1/2005 Mordue et al.
6,848,497 B2 2/2005 Sale et al.
6,869,564 B2 3/2005 Gilbert et al.
6,881,030 B2 4/2005 Thut
6,887,424 B2 5/2005 Ohno et al.
6,887,425 B2 5/2005 Mordue et al.
6,896,271 B2 5/2005 Uchida et al.
2001/0000465 A1 4/2001 Thut
2001/0012758 A1 8/2001 Bradley et al.
2002/0041788 A1 4/2002 Look et al.

| | | | |
|---|---|---|---|
| 2002/0102159 | A1 | 8/2002 | Thut |
| 2002/0146313 | A1 | 10/2002 | Thut |
| 2002/0187947 | A1 | 12/2002 | Jarai et al. |
| 2003/0059302 | A1 | 3/2003 | Mordue et al. |
| 2003/0075844 | A1 | 4/2003 | Mordue et al. |
| 2003/0151176 | A1 | 8/2003 | Ohno et al. |
| 2003/0185679 | A1 | 10/2003 | Mordue et al. |
| 2004/0007284 | A1 | 1/2004 | Look et al. |
| 2004/0022632 | A1 | 2/2004 | Thut |
| 2004/0056395 | A1 | 3/2004 | Thut |
| 2004/0076533 | A1 | 4/2004 | Cooper |
| 2004/0084172 | A1 | 5/2004 | Vincent et al. |
| 2004/0115079 | A1 | 6/2004 | Cooper |
| 2004/0123970 | A1 | 7/2004 | Neff |
| 2004/0199435 | A1 | 10/2004 | Abrams et al. |
| 2004/0215204 | A1 | 10/2004 | Davison et al. |
| 2004/0262825 | A1 | 12/2004 | Cooper |
| 2005/0013713 | A1 | 1/2005 | Cooper |
| 2005/0013714 | A1 | 1/2005 | Cooper |
| 2005/0013715 | A1 | 1/2005 | Cooper |
| 2005/0053499 | A1 | 3/2005 | Cooper |
| 2005/0077730 | A1 | 4/2005 | Thut |
| 2005/0081607 | A1 | 4/2005 | Patel et al. |
| 2005/0116398 | A1 | 6/2005 | Tremblay |

FOREIGN PATENT DOCUMENTS

| | | | |
|---|---|---|---|
| CH | 392268 | | 9/1965 |
| DE | 1800446 | | 12/1969 |
| EP | 0665378 | A1 | 2/1995 |
| GB | 942648 | | 11/1963 |
| GB | 1185314 | | 3/1970 |
| GB | 2217784 | A | 3/1989 |
| JP | 58-048796 | | 3/1983 |
| JP | 63-104773 | | 5/1998 |
| NO | 90756 | | 1/1958 |
| SU | 416401 | | 6/1974 |
| SU | 773312 | | 10/1980 |
| WO | WO 98/25031 | | 6/1998 |

* cited by examiner

PUMP WITH ROTATING INLET

CROSS-REFERENCE TO RELATED APPLICATIONS

This application is a continuation of, and claims priority under 35 U.S.C. §§ 119 and 120 to, U.S. patent application Ser. No. 10/619,405, filed on Jul. 14, 2003, by Paul V. Cooper, and U.S. patent application Ser. No. 10/620,318, filed on Jul. 14, 2003, by Paul V. Cooper.

FIELD OF THE INVENTION

The invention relates to a device used in a pump, particularly a pump for pumping molten metal, wherein the pump operates in an environment containing solid pieces of material that could jam the pump by lodging between a rotating rotor and a stationary inlet.

BACKGROUND OF THE INVENTION

As used herein, the term "molten metal" means any metal or combination of metals in liquid form, such as aluminum, copper, iron, zinc and alloys thereof. The term "gas" means any gas or combination of gases, including argon, nitrogen, chlorine, fluorine, freon, and helium, that are released into molten metal.

Known pumps for pumping molten metal (also called "molten-metal pumps") include a pump base (also called a housing or casing), one or more inlets, an inlet being an opening to allow molten metal to enter a pump chamber (and is usually an opening in the pump base that communicates with the pump chamber), a pump chamber, which is an open area formed within the pump base, and a discharge, which is a channel or conduit communicating with the pump chamber (in an axial pump the pump chamber and discharge may be the same structure or different areas of the same structure) leading from the pump chamber to the molten metal bath in which the pump base is submerged. A rotor, also called an impeller, is mounted in the pump chamber and is connected to a drive shaft. The drive shaft is typically a motor shaft coupled to a rotor shaft, wherein the motor shaft has two ends, one end being connected to a motor and the other end being coupled to the rotor shaft. The rotor shaft also has two ends, wherein one end is coupled to the motor shaft and the other end is connected to the rotor. Often, the rotor shaft is comprised of graphite, the motor shaft is comprised of steel, and the two are coupled by a coupling, which is usually comprised of steel.

As the motor turns the drive shaft, the drive shaft turns the rotor and the rotor pushes molten metal out of the pump chamber, through the discharge, which may be an axial or tangential discharge, and into the molten metal bath. Most molten metal pumps are gravity fed, wherein gravity forces molten metal through the inlet and into the pump chamber as the rotor pushes molten metal out of the pump chamber.

Molten metal pump casings and rotors usually employ a bearing system comprising ceramic rings wherein there are one or more rings on the rotor that align with rings in the pump chamber (such as rings at the inlet (which is usually the top of the pump chamber and bottom of the pump chamber) when the rotor is placed in the pump chamber. The purpose of the bearing system is to reduce damage to the soft, graphite components, particularly the rotor and pump chamber wall, during pump operation. A known bearing system is described in U.S. Pat. No. 5,203,681 to Cooper, the disclosure of which is incorporated herein by reference. As discussed in U.S. Pat. Nos. 5,591,243 and 6,093,000, each to Cooper, the disclosures of which are incorporated herein by reference, bearing rings can cause various operational and shipping problems and U.S. Pat. No. 6,093,000 discloses rigid coupling designs and a monolithic rotor to help alleviate this problem. Further, U.S. Pat. No. 2,948,524 to Sweeney et al., U.S. Pat. No. 4,169,584 to Mangalick, U.S. Pat. No. 5,203,681 to Cooper and U.S. Pat. No. 6,123,523 to Cooper (the disclosures of the aforementioned patents to Cooper are incorporated herein by reference) all disclose molten metal pumps.

The materials forming the components that contact the molten metal bath should remain relatively stable in the bath. Structural refractory materials, such as graphite or ceramics, that are resistant to disintegration by corrosive attack from the molten metal may be used. As used herein "ceramics" or "ceramic" refers to any oxidized metal (including silicon) or carbon-based material, excluding graphite, capable of being used in the environment of a molten metal bath. "Graphite" means any type of graphite, whether or not chemically treated. Graphite is particularly suitable for being formed into pump components because it is (a) soft and relatively easy to machine, (b) not as brittle as ceramics and less prone to breakage, and (c) less expensive than ceramics.

Three basic types of pumps for pumping molten metal, such as molten aluminum, are utilized: circulation pumps, transfer pumps and gas-release pumps. Circulation pumps are used to circulate the molten metal within a bath, thereby generally equalizing the temperature of the molten metal. Most often, circulation pumps are used in a reverbatory furnace having an external well. The well is usually an extension of a charging well where scrap metal is charged (i.e., added).

Transfer pumps are generally used to transfer molten metal from the external well of a reverbatory furnace to a different location such as a ladle or another furnace. Examples of transfer pumps are disclosed in U.S. Pat. No. 6,345,964 B1 to Cooper, the disclosure of which is incorporated herein by reference, and U.S. Pat. No. 5,203,681.

Gas-release pumps, such as gas-injection pumps, circulate molten metal while releasing a gas into the molten metal. In the purification of molten metals, particularly aluminum, it is frequently desired to remove dissolved gases such as hydrogen, or dissolved metals, such as magnesium, from the molten metal. As is known by those skilled in the art, the removing of dissolved gas is known as "degassing" while the removal of magnesium is known as "demagging." Gas-release pumps may be used for either of these purposes or for any other application for which it is desirable to introduce gas into molten metal. Gas-release pumps generally include a gas-transfer conduit having a first end that is connected to a gas source and a second submerged in the molten metal bath. Gas is introduced into the first end and is released from the second end into the molten metal. The gas may be released downstream of the pump chamber into either the pump discharge or a metal-transfer conduit extending from the discharge, or into a stream of molten metal exiting either the discharge or the metal-transfer conduit. Alternatively, gas may be released into the pump chamber or upstream of the pump chamber at a position where it enters the pump chamber. A system for releasing gas into a pump chamber is disclosed in U.S. Pat. No. 6,123,523 to Cooper. Furthermore, gas may be released into a stream of molten metal passing through a discharge or metal-transfer conduit wherein the position of a gas-release opening in the metal-transfer conduit enables pressure from the molten metal stream to assist in drawing gas into the molten metal stream. Such a structure and method is disclosed in a copending application entitled "System for Releasing Gas Into Molten Metal," invented by Paul V. Cooper, and filed on Feb. 4, 2004, the disclosure of which is incorporated herein by reference.

When a conventional molten metal pump is operated, the rotor rotates within the pump housing and the pump housing, inlet and pump chamber remain stationary relative to the rotor, i.e., they do not rotate. A problem with such molten metal pumps is that the molten metal in which it operates includes solid particles, such as dross and brick. As the rotor rotates molten metal including the solid particles enters the pump chamber through the inlet. A solid particle may lodge between the moving rotor and the stationary inlet, potentially jamming the rotor and potentially damaging one or more of the pump components, such as the rotor or rotor shaft of the pump.

Many attempts have been made to solve this problem, including the use of filters or disks to prevent solid particles from entering the inlet and the use of a non-volute pump chamber to increase the space between the inlet and rotor to allow solid pieces to pass into the pump chamber without jamming, where they can be pushed through the discharge by the action of the rotor.

SUMMARY OF THE INVENTION

The present invention alleviates these problems by providing a device that essentially combines the inlet and rotor into a single component that rotates in the pump base. Consequently, solid particles cannot jam between a moving rotor and a stationary inlet since the inlet rotates with the rotor blades. The device includes a displacement structure, such as rotor blades, for displacing (i.e., moving) molten metal, and an inlet structure that defines one or more inlets (i.e., openings) through which molten metal can pass.

The displacement structure is preferably a plurality of imperforate rotor blades. The rotor blades may be of any size or configuration suitable to move molten metal in a pump chamber, and are preferably configured to move molten metal both downward towards the bottom of the pump chamber and outward through the pump discharge. However, any structure suitable for displacing molten metal in a pump camber may be used.

The inlet structure can be of any size or configuration suitable for defining one or more openings through which molten metal may pass. Molten metal can pass through the openings where it ultimately enters the pump chamber and is displaced by the displacement structure.

The device also may include a flow-blocking plate to block an opening in the bottom or top of the pump base and a bearing surface for aligning with a corresponding bearing surface on a pump base, but the flow-blocking plate and bearing surface are each optional.

Preferably, the device is positioned in the pump chamber of a molten metal pump. The device is attached to a drive shaft and is rotated as the drive shaft rotates. In operation, as the device rotates within the pump chamber molten metal enters the opening(s) of the inlet structure and is displaced from the pump chamber into the discharge by the displacement structure.

If a device according to the invention includes one or more bearing surfaces, the bearing surfaces may have one or more grooves formed therein. The groove(s) may be of any shape or size sufficient to help alleviate a build up of molten metal between the device's bearing surface(s) and the corresponding bearing surface(s) on a pump base. Alternatively, the grooves may be formed on the bearing surface of the pump base or on both the bearing surface(s) of the pump base and the bearing surface(s) of the device. Moreover, not just a device as described herein, but any impeller for use in molten metal, wherein the impeller includes a bearing surface, could utilize grooves in the bearing surface according to the invention.

DETAILED DESCRIPTION OF A PREFERRED EMBODIMENT

Figure 1:
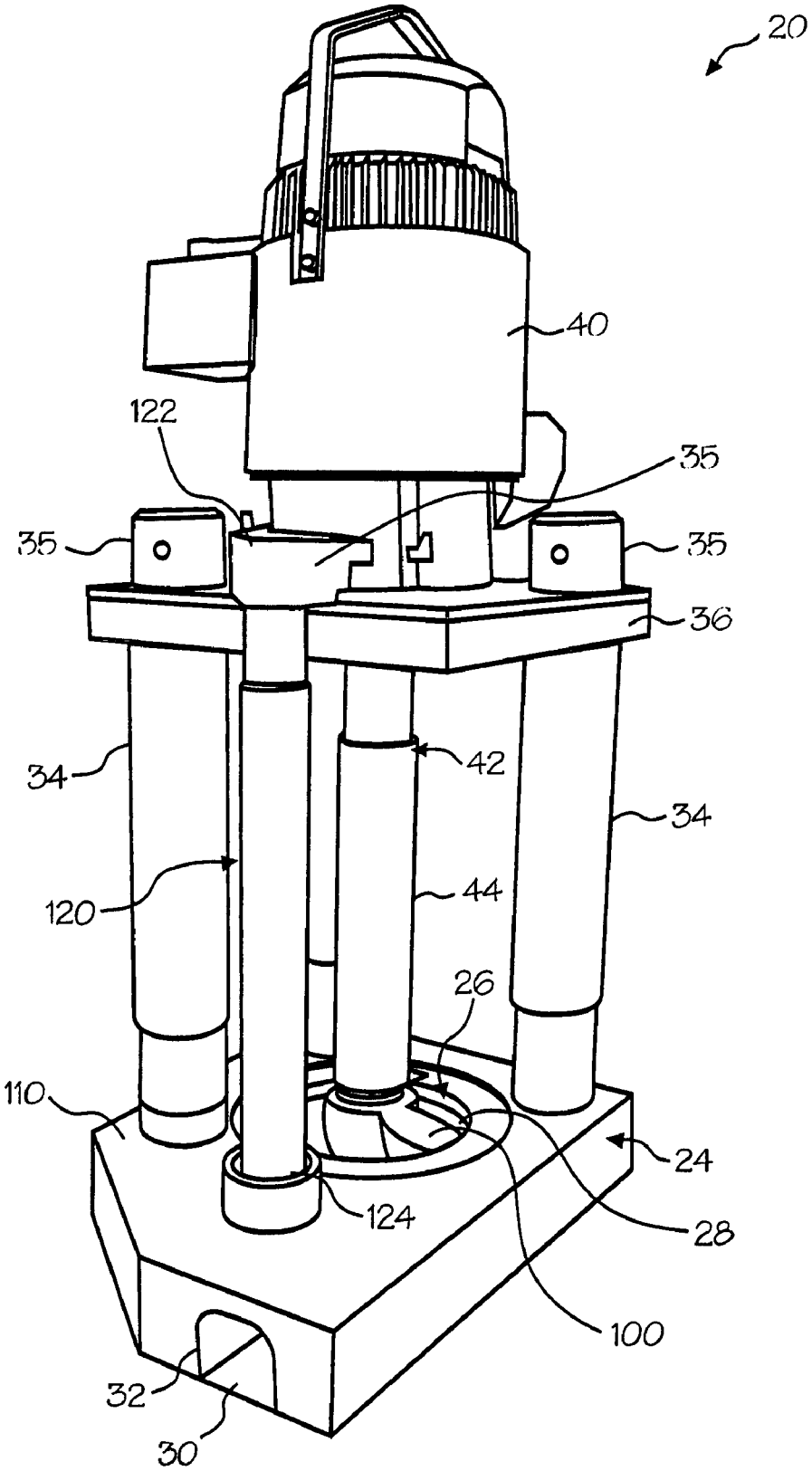
FIG. 1 is a perspective view of a pump for pumping molten metal, which includes a device according to the invention.

Referring now to the drawing where the purpose is to illustrate and describe different embodiments of the invention, and not to limit same, FIG. 1 shows a molten metal pump 20 that includes a device 100 in accordance with the present invention. Pump 20 is usually positioned in a molten metal bath B in a pump well, which is part of the open well of a reverbatory furnace.

The components of pump 20, including device 100, that are exposed to the molten metal are preferably formed of structural refractory materials, which are resistant to degradation in the molten metal. Carbonaceous refractory materials, such as carbon of a dense or structural type, including graphite, graphitized carbon, clay-bonded graphite, carbon-bonded graphite, or the like have all been found to be most suitable because of cost and ease of machining. Such components may be made by mixing ground graphite with a fine clay binder, forming the non-coated component and baking, and may be glazed or unglazed. In addition, components made of carbonaceous refractory materials may be treated with one or more chemicals to make the components more resistant to oxidation. Oxidation and erosion treatments for graphite parts are practiced commercially, and graphite so treated can be obtained from sources known to those skilled in the art.

Pump 20 can be any structure or device for pumping or otherwise conveying molten metal, such as the pump disclosed in U.S. Pat. No. 5,203,681 to Cooper, or an axial pump having an axial, rather than tangential, discharge. Preferred pump 20 has a pump base 24 for being submersed in a molten metal bath. Pump base 24 preferably includes a generally nonvolute pump chamber 26, such as a cylindrical pump chamber or what has been called a "cut" volute, although pump base 24 may have any shape pump chamber suitable of being used, including a volute-shaped chamber. Chamber 26 may be constructed to have only one opening, either in its top or bottom, if a tangential discharge is used, since only one opening is required to introduce molten metal into pump chamber 26. Generally, pump chamber 24 has two coaxial openings of the same diameter and usually one is blocked by a flow blocking plate mounted on the bottom of, or formed as part of, device 100. As shown, chamber 26 includes a top opening 28, bottom opening 29, and wall 31. Base 24 further includes a tangential discharge 30 (although another type of discharge, such as an axial discharge may be used) in fluid communication with chamber 26. Base 24 has sides 112, 114, 116, 118 and 120 and a top surface 110. The top portion of wall 31 is machined to receive a bearing surface, which is not yet mounted to wall 31. The bearing surface is typically comprised of ceramic and cemented to wall 31.

One or more support post receiving bores 126 are formed in base 24 and are for receiving support posts 34. In this embodiment, pump base 24 receives a gas-transfer conduit in stepped opening 128, which includes first opening 128A and second opening 128B defined by a bore 112. The invention is not limited to any particular type or configuration of base, however. A pump base used with the invention could be of any size, design or configuration suitable for utilizing a device or impeller according to the invention.

Pump base 24 is also described in copending application entitled "System for Releasing Gas Into Molten Metal" to Paul V. Cooper and filed on Feb. 4, 2004.

Figure 2:
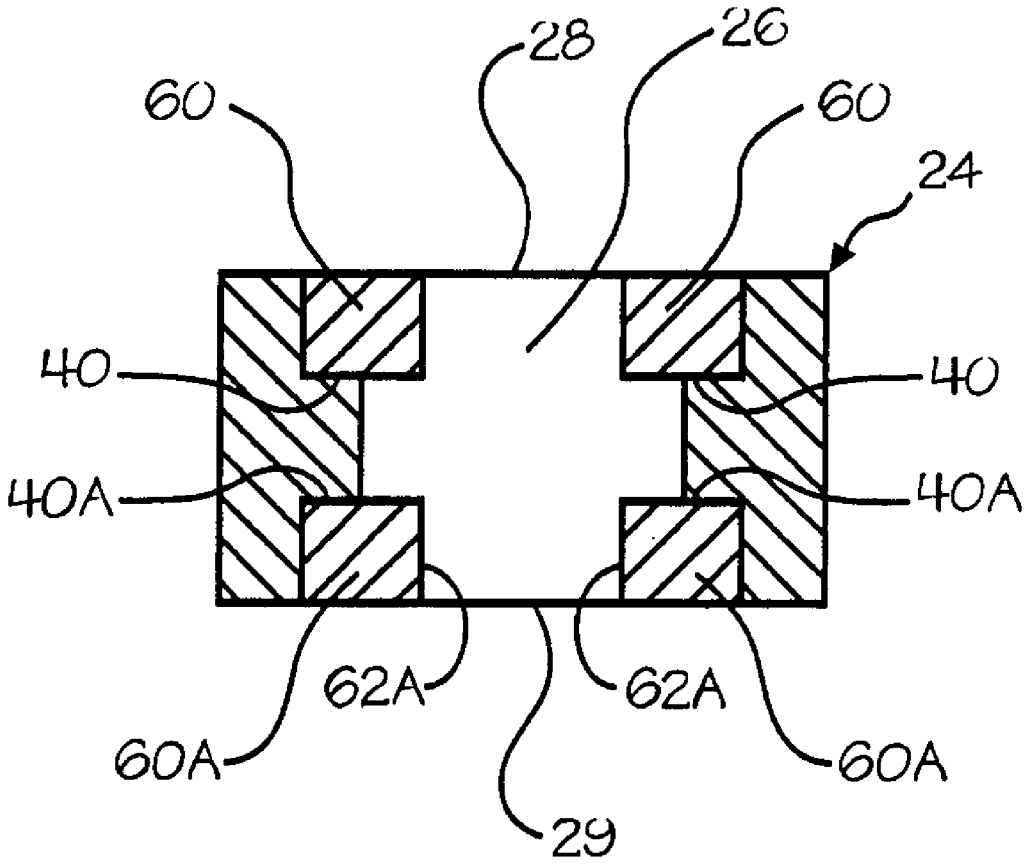
FIG. 2 is a partial, cross-sectional view of a pump base that may be used to practice the invention.
Figure 2A:
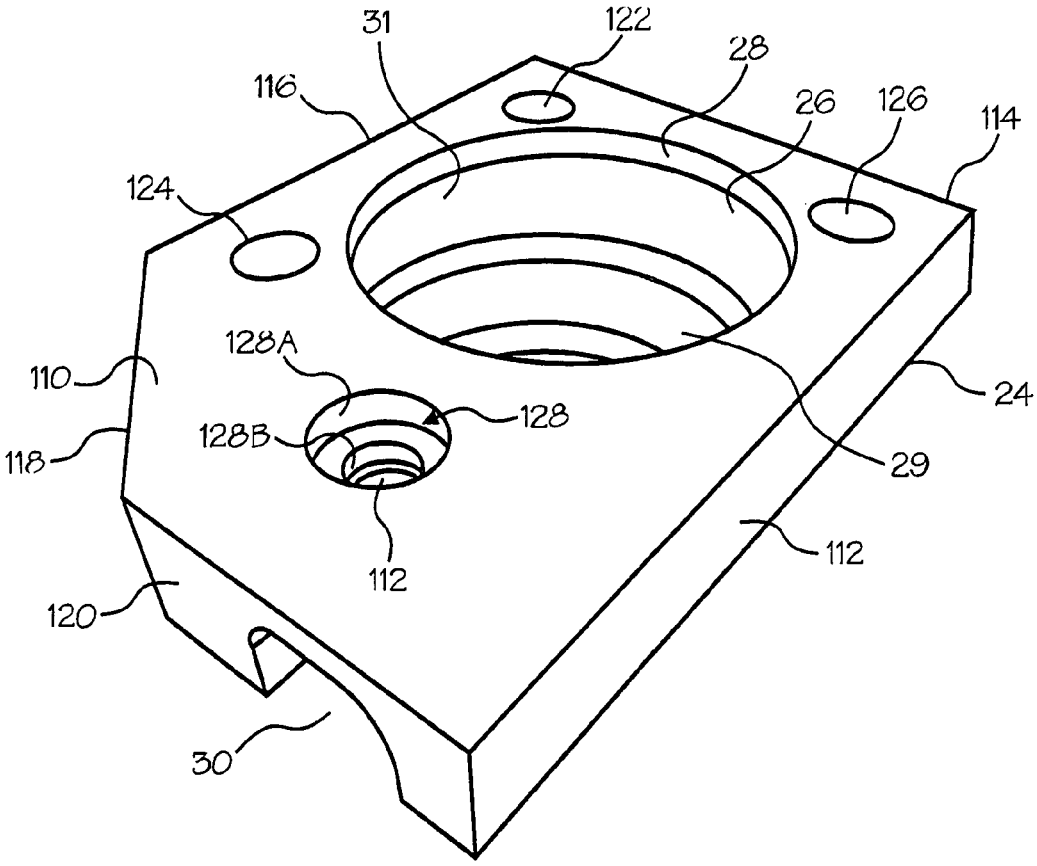
FIG. 2*a* is a perspective view of a pump base that may be used to practice the invention.

As shown in FIG. 2, pump base 24 can have a stepped surface 40 defined at the periphery of chamber 26 at inlet 28 and a stepped surface 40A defined at the periphery of inlet 29. Stepped surface 40 preferably receives a bearing ring member 60 and stepped surface 40A preferably received a bearing ring member 60A. Each bearing member 60, 60A is preferably comprised of silicon carbide, although any suitable material may be used. The outer diameter of members 60, 60A varies with the size of the pump, as will be understood by those skilled in the art. Bearing members 60, 60A each has a preferred thickness of 1". Preferably, bearing ring member 60 is provided at inlet 28 and bearing ring member 60A is provided at inlet 29, respectively, of casing 24. Alternatively, bearing ring members 60, 60A need not be used. In the preferred embodiment, bottom bearing ring member 60A includes an inner perimeter, or first bearing surface, 62A, that aligns with a second bearing surface and guides rotor 100 as described herein. Although bearing rings 60, 60A may be used, any suitable bearing surface(s) may be used if one is to be used at all. It is most preferred that a bearing surface with one or more grooves, such as the surface on bearing member 150 described herein be utilized. Additionally, device 100 may include a bearing ring, bearing pin or bearing members, such as the ones disclosed in U.S. Pat. No. 6,093,000 to Cooper One or more support posts 34 connect base 24 to a superstructure 36 of pump 20 thus supporting superstructure 36, although any structure or structures capable of supporting superstructure 36 may be used. Additionally, pump 20 could be constructed so there is no physical connection between the base and the superstructure, wherein the superstructure is independently supported. The motor, drive shaft and rotor could be suspended without a superstructure, wherein they are supported, directly or indirectly, to a structure independent of the pump base.

In the preferred embodiment, post clamps 35 secure posts 34 to superstructure 36. A preferred post clamp and preferred support posts are disclosed in a copending application entitled "Support Post System for Molten Metal Pump," invented by Paul V. Cooper, and filed on Feb. 4, 2004, the disclosure of which is incorporated herein by reference.

A motor 40, which can be any structure, system or device suitable for driving pump 20, but is preferably an electric or pneumatic motor, is positioned on superstructure 36 and is connected to an end of a drive shaft 42. A drive shaft 42 can be any structure suitable for rotating an impeller, and preferably comprises a motor shaft (not shown) coupled to a rotor shaft. The motor shaft has a first end and a second end, wherein the first end of the motor shaft connects to motor 40 and the second end of the motor shaft connects to the coupling. Rotor shaft 44 has a first end and a second end, wherein the first end is connected to the coupling and the second end is connected to device 100 or to an impeller according to the invention. A preferred coupling, rotor shaft and connection between the rotor shaft and device 100 are disclosed in a copending application entitled "Molten Metal Pump Components," invented by Paul V. Cooper and filed on Feb. 4, 2004, the disclosure of which is incorporated herein by reference.

The preferred device 100, seen best in FIGS. 5-10, is sized to fit through both openings 28 and 29, although it could be of any shape or size suitable to be used in a molten metal pump. The preferred dimensions of device 100 will depend upon the size of pump 20 because the size of a rotor or device according to the invention varies with the size of the pump and on manufacturer's specifications. Device 100 can be comprised of a single material, such as graphite or ceramic, or can be comprised of different materials. For example, inlet structure 104 may be comprised of ceramic and the displacement structure 102 may be comprised of graphite, or vice versa. Any part or all of device 100 may also include a protective coating as described in co-pending U.S. application Ser. No. 10/619,405, entitled "Protective Coatings for Molten Metal Devices," invented by Paul V. Cooper and filed on Jul. 14, 2003.

Device 100 is preferably circular in plan view (although device 100 can be of any shape suitable for use in a molten metal pump) and includes a displacement structure 102, an inlet structure 104, a top surface 106, a bottom surface 108, and a connective portion 110.

Displacement structure 102 is any structure(s) or device(s) suitable for displacing molten metal in a pump casing and through the discharge. Structure 102 preferably comprises one or more imperforate rotor blades (as best seen in FIGS. 5-10), although it may include any structure suitable for displacing molten metal through the discharge, such as perforate rotor blades or another perforate structure. For example, displacement structure 102 could be or include a bird-cage device, this term being known to those skilled in the art.

Displacement structure 102 as shown has three rotor blades, or vanes, 102A, 102B and 102C, for displacing molten metal, although any number of vanes could be used. Displacement structure 102 preferably has a structure that directs flow into pump chamber 26 and a structure that directs flow towards pump chamber wall 31. Preferably this structure is either (1) one or more rotor blades with a portion that directs molten metal into chamber 26 and a portion that directs molten metal outward towards chamber wall 31, or (2) at least one vane that directs molten metal into pump chamber 26, and at least one vane that directs molten metal towards chamber wall 31. In the preferred embodiment each vane 102A, 102B and 102C has the same configuration (although the respective vanes could have different configurations) so only one vane will be described in detail.

Figure 5:
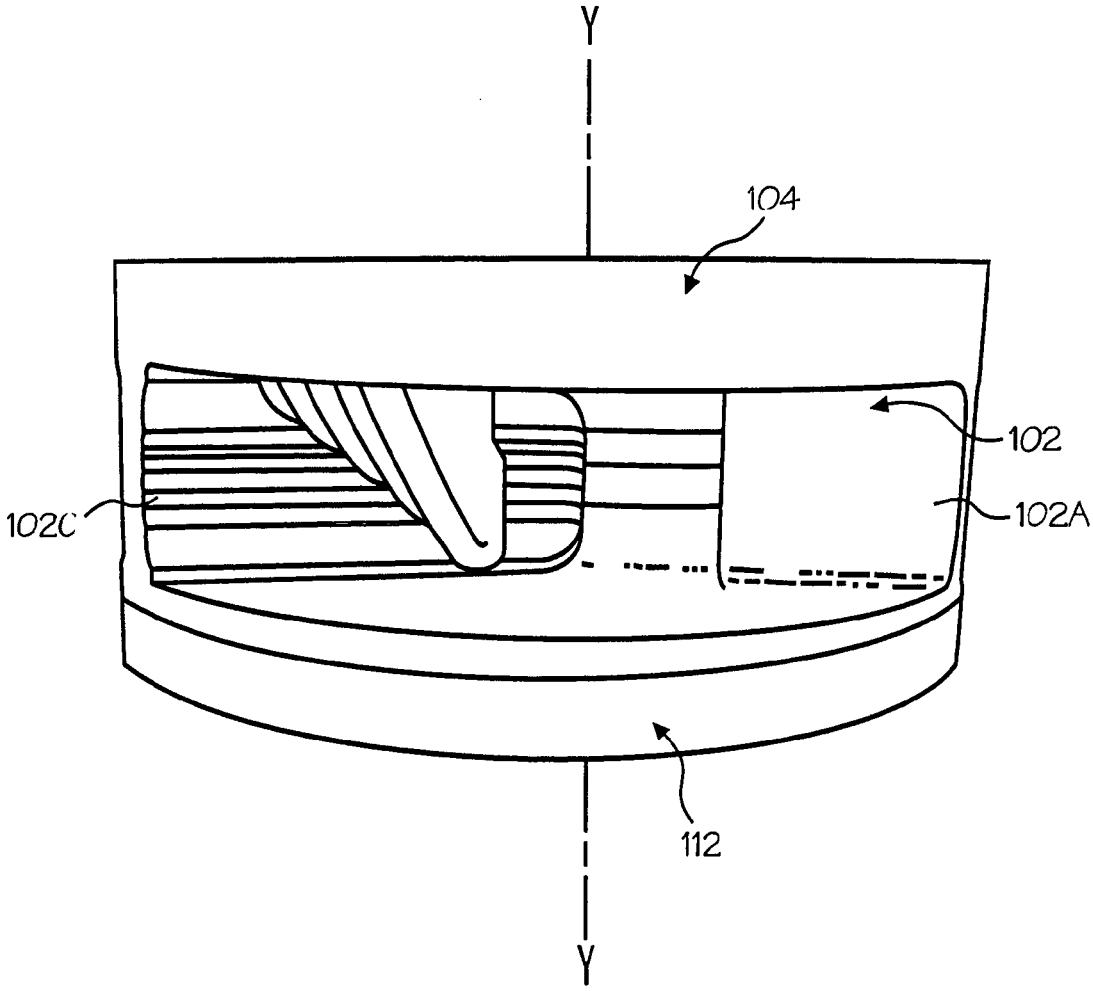
FIG. 5 is a side view of the device of FIG. 2.
Figure 7:
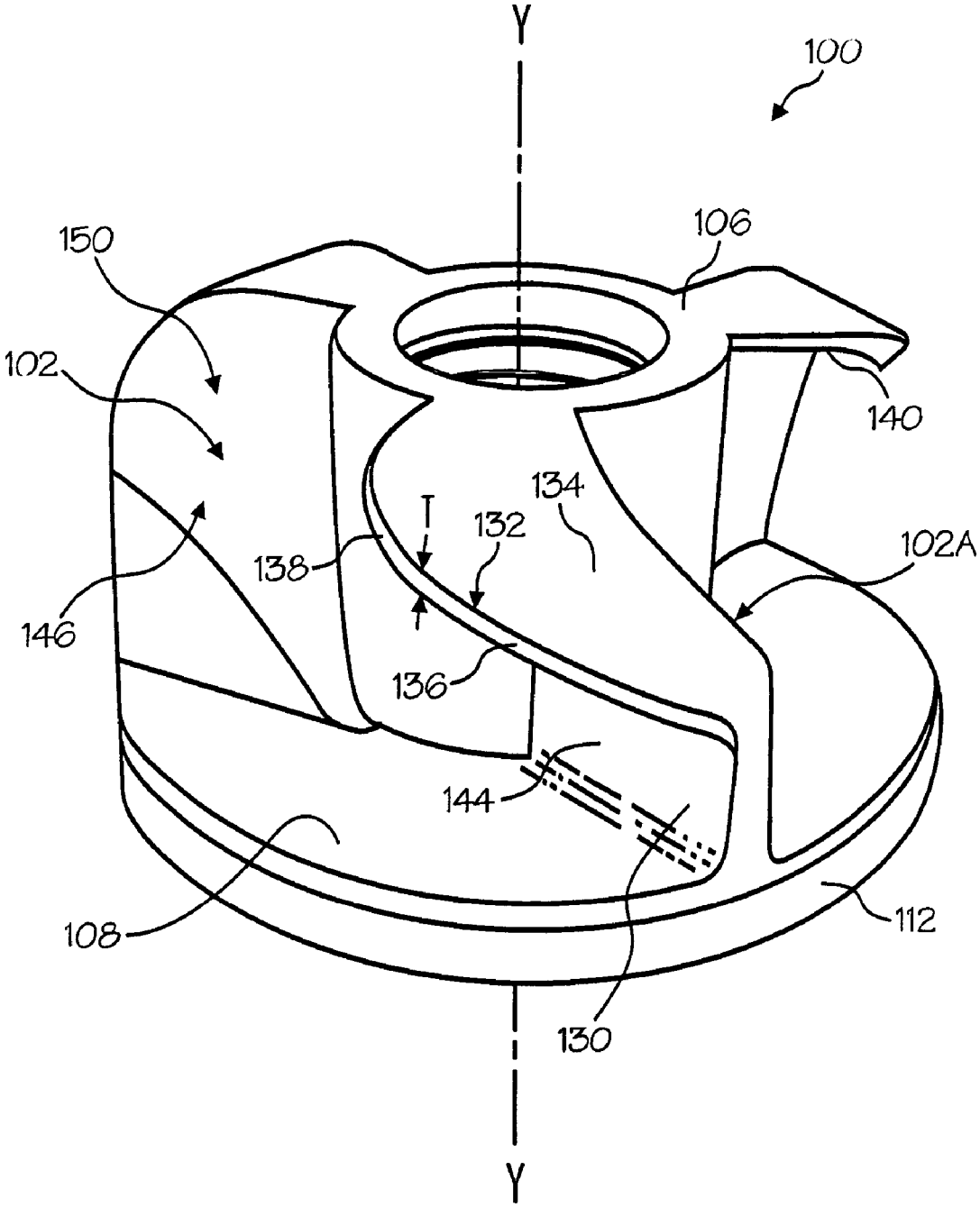
FIG. 7 is a top, perspective view of a device according to the invention with the inlet structure removed.
Figure 8:
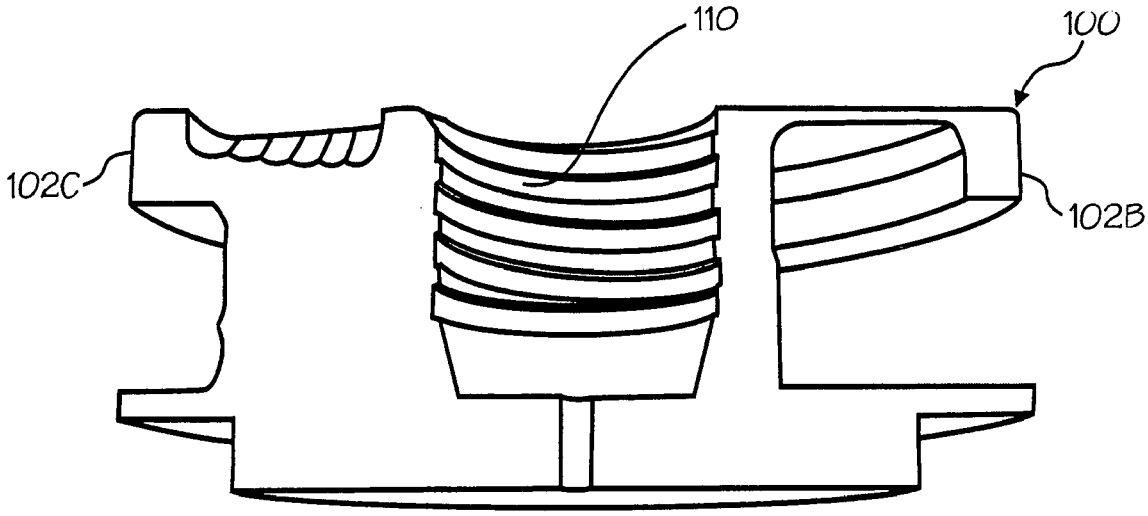
FIG. 8 is a sectional side view of the device of FIG. 2 cut in half.

Vane 102A preferably includes a vertically-oriented portion 130 and a horizontally-extending portion 132. The respective vertical and horizontal orientation of the portions described herein is in reference to device 100 positioned in a standard pump having an opening in the top surface of the pump housing through which molten metal can enter the pump chamber, and wherein device 100 is oriented around a vertical axis Y as shown in FIGS. 5 and 7. The invention, however, could utilize any device wherein the inlet structure is connected to the displacement structure, and that is used in any molten metal pump, whether the inlet(s) are located adjacent one or more of the top surface, bottom surface or a side surface of the pump casing. It will be therefore understood that the terms "horizontal" and "vertical" refer to the rotor when it is in the orientation shown in FIGS. 3, 5 and 7.

In the preferred embodiment, when device 100 is mounted in pump chamber 26, portion 132 (also called a projection or horizontally-extending projection) is positioned closer to opening 28 than portion 130. This is because the molten metal in bath B outside of chamber 26 should first be directed into chamber 26 before being directed outward towards chamber wall 31 and ultimately through discharge 30. Projection 132 has a top surface 134 preferably flush with top surface 106 and opening 28, and a bottom surface 136. However, top surface 134 and projection 132 may be positioned partially or entirely outside or inside of chamber 26.

Projection 132 further includes a leading edge 138 and an angled surface (or first surface) 140, which is preferably formed in surface 134 adjacent leading edge 138. As will be understood, surface 140 is angled (as used herein the term angled refers to both a substantially planar surface, or a curved surface, or a multi-faceted surface) such that, as device 100 turns (as shown in FIG. 1 it turns in a clockwise direction) surface 140 directs molten metal into pump chamber 26 (i.e., towards optional flow blocking and bearing plate 112 in the embodiment shown). Any surface that functions to direct molten metal into chamber 26 can be used, but it is preferred that surface 140 is substantially planar and formed at a 10°-60°, and most preferably, a 20° angle.

Leading edge 138 has a thickness T. Thickness T is preferably about ¼" and prevents too thin an edge from being formed when surface 140 is machined into projection 132. This reduces the likelihood of breakage during shipping or handling of device 100, but is not related to the overall function of device 100 during operation of pump 20.

Portion 130, which is preferably vertical (but can be angled or curved), extends from the back (or trailing portion) of projection 132 to surface 108. Portion 130 has a leading face (or second surface) 144 and a trailing face 146. Leading face 144 is preferably planar and vertical, although it can be of any configuration that directs molten metal outward against wall 31 of chamber 26.

A recess 150 is formed in top surface 106 and preferably extends from top surface 106 to trailing face 146. As shown, recess 150 begins at a position on surface 106 slightly forward of face 146 and terminates at a position on face 146. The purpose of recess 150 is to reduce the area of top surface 106, thereby creating a larger opening for molten metal to enter chamber 26, which increases the output of pump 20 and can lead to lower operating speeds, less pump vibration and longer component life.

Figure 3:
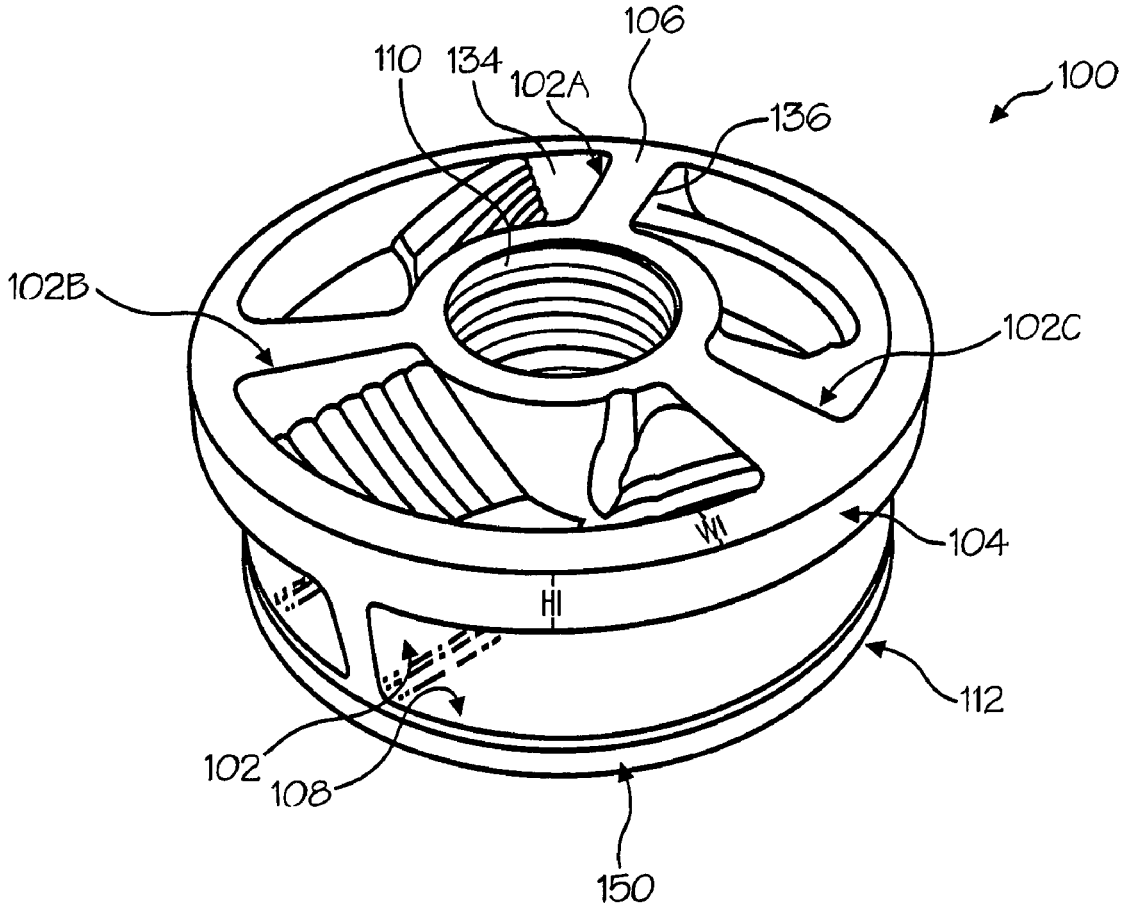
FIG. 3 is a top, perspective view of a device according to the invention.
Figure 4:
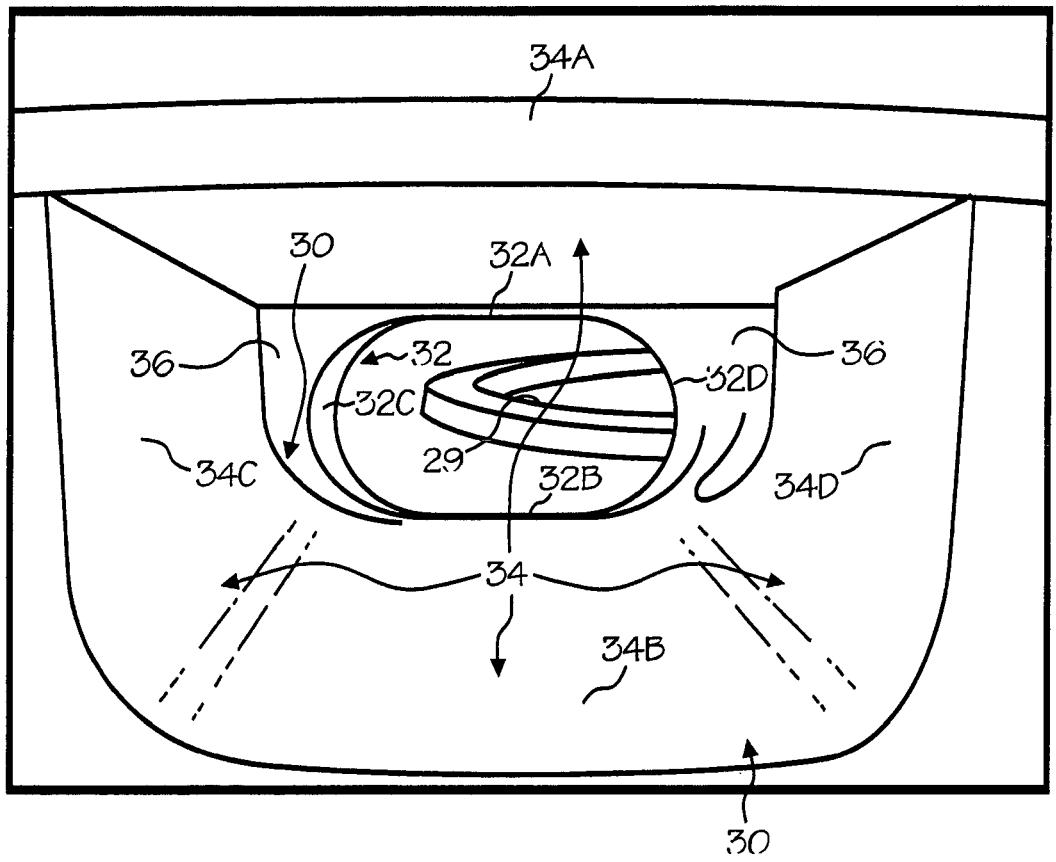
FIG. 4 is a view inside the preferred discharge of the pump of FIG. 1.
Figure 6:
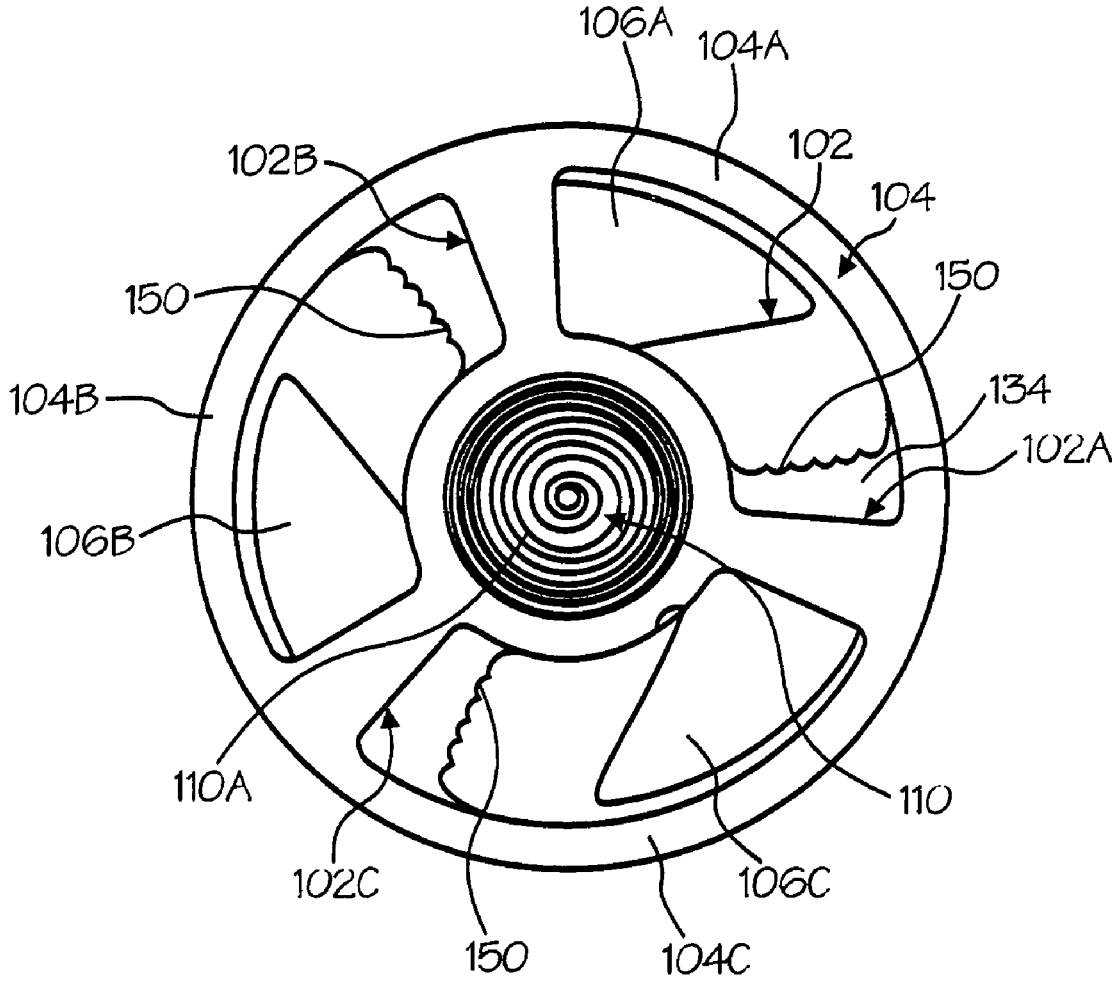
FIG. 6 is a top view of the device of FIG. 2.

Inlet structure 104 preferably has three inlet perimeters 104A, 104B and 104C that help to define inlets (or openings) 106A, 106B and 106C, as best seen in FIGS. 3 and 6. Structure 104 can be any device, structure or component(s) capable of defining one or more inlets attached to, connected to or formed as part of the displacement structure. As used with respect to the inlet structure-displacement structure connection, the terms "connected," "connection," attached" and attachment" mean connected or attached in any way, either directly or indirectly, so that the inlets and displacement structure rotate as pump 20 is operated. Additionally, a device according to the invention encompasses any inlet structure that rotates as the displacement structure rotates, such as an inlet structure mounted to the same drive shaft as the displacement structure, but otherwise not physically connected to the displacement structure.

Inlets 106A, 106B and 106C can be any size or shape suitable for allowing molten metal to pass into pump chamber 26 so the molten metal can be displaced by displacement structure 102. Additionally, any number of inlets suitable for a given displacement structure configuration may be used. Preferably, the inlet(s) are as large as possible to allow for the maximum flow of molten metal into chamber 26.

Figure 9:
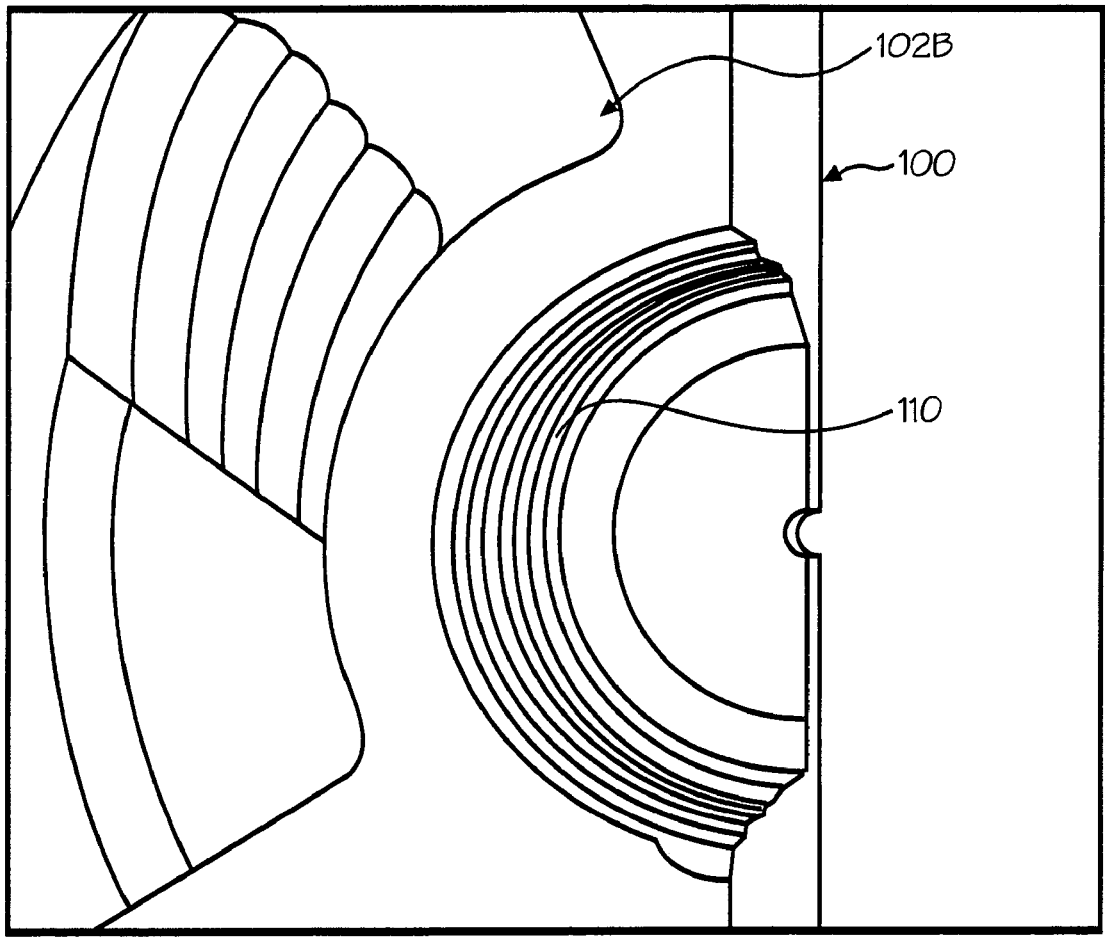
FIG. 9 is a partial top view of the device of FIG. 8.
Figure 10:
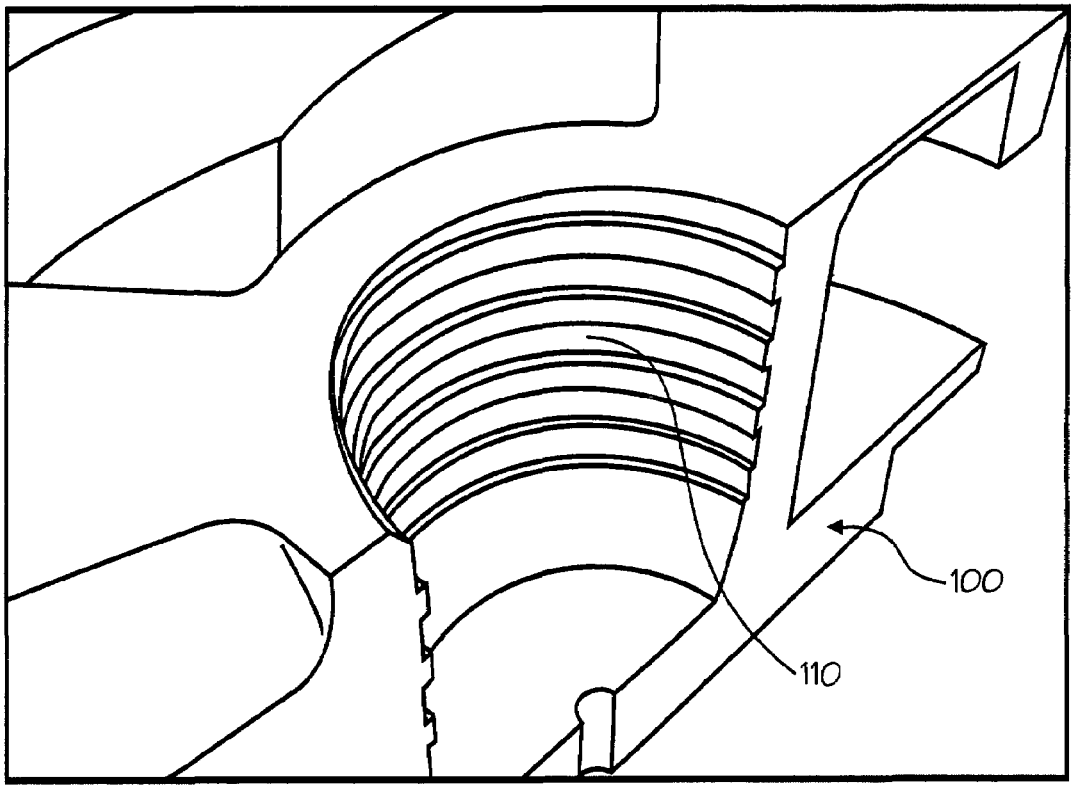
FIG. 10 is a partial perspective view of the device of FIG. 8.
Figure 11:
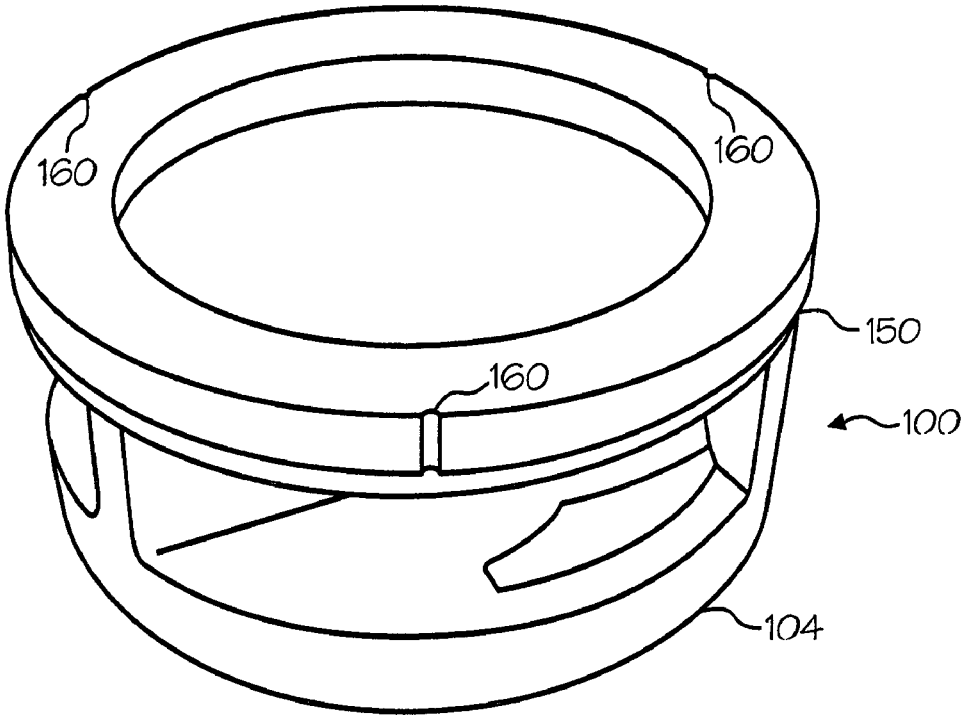
FIG. 11 is a device according to the invention including a bearing surface with grooves.

Device 100 also has a connective portion 110 to connect to end 38B of rotor shaft 38. Connective portion 110 preferably has includes a threaded bore 110A that threadingly receives second end 38B of rotor shaft 38, although any connection capable of attaching shaft 38 to device 100 and that enables shaft 38 to rotate device 100 may be used. A preferred flat-thread configuration is best seen in FIGS. 9-11, and is described in co-pending U.S. application Ser. No. 10/620,318 to Paul V. Cooper and entitled "Couplings For Molten Metal Devices,." filed on Jul. 14, 2003.

An optional flow-blocking and bearing plate, 112 is mounted on either the top 106 or bottom 108 of device 100, depending upon the location of the pump inlet. Plate 112 is preferably comprised of ceramic, is cemented to top 106 or bottom 108, and is sized to rotatably fit and be guided by the appropriate one of bearing ring members 60 or 60A mounted in pump casing 24, shown in FIG. 2, although even if plate 112 is used, there need not be a bearing ring in pump casing 24.

Further, if pump 20 was a dual inlet pump, having inlets at the top and bottom of pump chamber 24 and device 100 had no flow blocking plate, the device according to the invention would preferably have one or more inlets formed adjacent top surface 106, as shown, and one or more inlets formed in bottom surface 108, wherein the top and bottom inlets would preferably rotate as the device rotated. However, the invention covers a device wherein the inlet(s) are at either the top or bottom of the device or both, when used in a dual-flow pump, and the inlets rotate as the device rotates.

As device 100 is rotated by drive shaft 12, displacement structure 102 and inlet structure 104 rotate. Thus, in the preferred embodiment, rotor blades 102A, 102B and 102C and inlets 106A, 106B and 106C rotate as a unit. Therefore, solid particles in the molten metal cannot lodge between a rotating rotor and a stationary inlet. This reduces the likelihood of a solid particle jamming between the inlet and the rotor and causing damage to any of the pump components.

In the embodiment shown, top surface 108 of device 100 is substantially flush with the top surface of pump base 26. However, device 100 may be sized or positioned so it extends beyond the top surface of pump base 26, or device 100 may include projections that extend beyond the top surface of base 26 to deflect solid particles.

Figure 12:
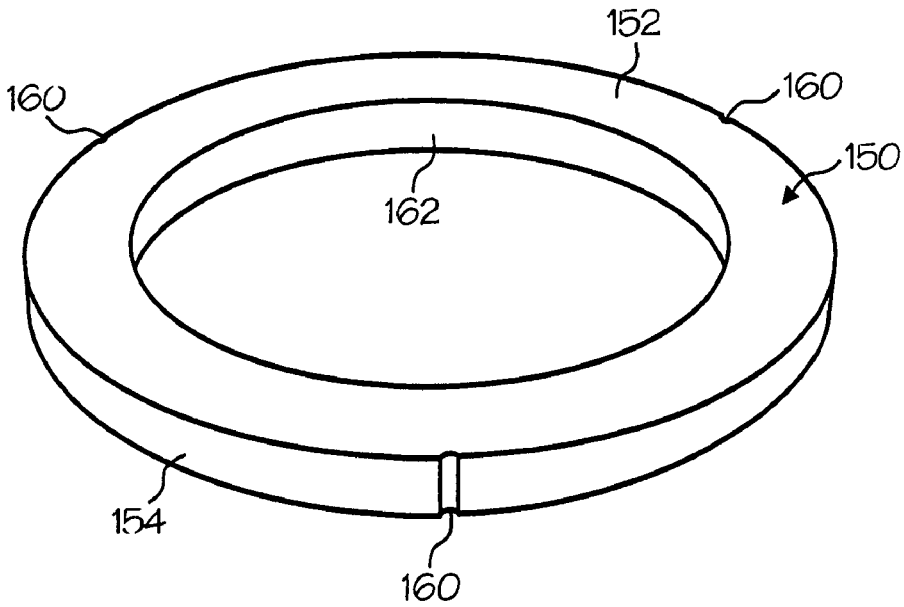
FIG. 12 is a bearing surface for use with either a device according to the invention or with any impeller for use in a molten metal pump.

FIGS. 11 and 12 show a bearing surface that may be used to practice the invention. FIG. 11 shows device 100 including bearing ring 150 and FIG. 12 shows ring 150. Ring 150 is preferably comprised of a ceramic such as silicon carbide although any suitable material may be used. Ring 150 is mounted on the bottom of device 100 in this embodiment but may be mounted anywhere on device 100 suitable for aligning device 100 in a pump chamber with which device 200 shall be used. Ring 150 includes a top surface 152, a bearing surface 154, one or more grooves 160 and inner surface 162.

Grooves 160 are for alleviating the build up of molten metal between bearing surface 154 and the corresponding bearing surface on the pump base with which device 100 is used. As device 100 (or an impeller) rotates in a pump chamber, a thin film of molten metal sometimes forms between the bearing surface of the device or impeller and the bearing surface of the pump. This film can partially or entirely solidify causing operational difficulties. Utilizing one or more grooves 160 alleviates this problem because the bearing surface becomes interrupted and wipes away the molten metal film. As shown there are three grooves 160 radially spaced equally about surface 154, although any suitable number may be used. As shown each groove has a radiused cross section and is about ½" wide and ½" deep and extends across the entire width of surface 154. It is preferred that each groove be between ¼" and 2" wide and have a depth of ¼" to 1", although any suitable size or shape of groove for wiping away the molten metal film may be used. Alternatively, the grooves may be formed on the bearing surface of a pump base, or on both the bearing surface of a pump base and a device according to the invention.

Having thus described different embodiments of the invention, other variations and embodiments that do not depart from the spirit of the invention will become apparent to those skilled in the art. The scope of the present invention is thus not limited to any particular embodiment, but is instead set forth in the appended claims and the legal equivalents thereof. Unless expressly stated in the written description or claims, the steps of any method recited in the claims may be performed in any order capable of yielding the desired product.

What is claimed is:

1. A pump for pumping molten metal, the pump comprising: (a) a motor; (b) a pump base including a pump chamber and a discharge through which a stream of molten metal is defined; (c) a device at least partially positioned in the pump chamber, the device comprising: (i) an inlet structure defining one or more openings through which molten metal can pass; (ii) a displacement structure connected to the inlet structure, the displacement structure for displacing molten metal and having a portion that directs molten metal downward and a portion that directs molten metal outward; and (d) a drive shaft connecting the motor to the device; wherein as the device is rotated, both the inlet structure and displacement structure rotate.

2. The pump of claim 1 that further includes a superstructure connected to the pump base by one or more support posts.

3. The pump of claim 1 wherein the motor is positioned on the superstructure.

4. The pump of claim 1 wherein the drive shaft comprises a motor shaft having a first end and a second end, a coupling having a first end and a second end, and a rotor shaft having a first end and a second end, the first end of the motor shaft being connected to the motor and the second end of the motor shaft being connected to the first end of the coupling, the first end of the rotor shaft being connected to the second end of the coupling and the second end of the rotor shaft being connected to the device.

5. The pump of claim 1 wherein the device further includes a bearing surface.

6. The pump of claim 5 wherein the bearing surface includes one or more grooves to help alleviate a build up of molten metal between the bearing surface and a corresponding bearing surface in the pump base.

7. The pump of claim 1 wherein the displacement structure is one or more rotor blades.

8. The pump of claim 7 wherein the one or more rotor blades are comprised of graphite.

9. The pump of claim 7 wherein the one or more rotor blades are imperforate.

10. The pump of claim 1 wherein the inlet structure is comprised of graphite.

11. The pump of claim 1 wherein the inlet structure is comprised of ceramic.

12. The pump of claim 1 wherein the pump base has a tangential discharge.

13. The pump of claim 1 that is a transfer pump and includes a metal-transfer conduit connected to the discharge.

14. The pump of claim 13 wherein the metal-transfer conduit is connected to the pump base without the use of cement or other sealant.

15. The pump of claim 1 that further includes a gas-release device for releasing gas into a molten metal stream generated by the pump.

16. The pump of claim 15 wherein the gas-release device comprises a gas-transfer conduit having an end connected to the pump discharge for releasing gas into molten metal passing through the pump discharge.

17. The pump of claim 1 that includes a metal-transfer conduit extending from the pump discharge and a gas-transfer conduit having an end connected to the metal-transfer conduit for transferring gas to the metal-transfer conduit.

18. The pump of claim 1 wherein there are three openings.

19. The pump of claim 1 wherein there are three rotor blades.

20. The pump of claim 1 wherein the device includes a threaded connection for connecting to a rotor shaft.

* * * * *